United States Patent [19]

Sigl et al.

[11] Patent Number: 4,601,065

[45] Date of Patent: Jul. 22, 1986

[54] BIB WITH CRUMB CATCHER

[75] Inventors: Wayne C. Sigl, Neenah; Dan D. Endres, Appleton; Christine C. Habert, Neenah, all of Wis.

[73] Assignee: Kimberly-Clark Corporation, Neenah, Wis.

[21] Appl. No.: 735,496

[22] Filed: May 17, 1985

Related U.S. Application Data

[63] Continuation-in-part of Ser. No. 638,187, Aug. 6, 1984.

[51] Int. Cl.[4] ..... A41B 13/10

[52] U.S. Cl. ..... 2/49 R

[58] Field of Search ..... 2/49 R, 50, 48, 51, 2/49 A

[56] References Cited

U.S. PATENT DOCUMENTS

| | | | |
|---|---|---|---|
| 2,367,383 | 1/1945 | Tiscornia | 2/49 R |
| 2,423,489 | 7/1947 | Dunn | 2/49 |
| 2,782,420 | 2/1957 | Barager | 2/49 |
| 3,001,646 | 9/1961 | Cooper | 2/49 |
| 3,146,464 | 9/1964 | Burnett | 2/49 |
| 3,328,807 | 7/1967 | Strauss | 2/49 |
| 3,329,969 | 7/1967 | Farber et al. | 2/49 R |
| 3,416,157 | 12/1968 | Marder et al. | 2/49 |
| 3,979,776 | 9/1976 | Gruenwald | 2/49 |
| 3,995,321 | 12/1976 | Johnson | 2/49 |
| 3,999,221 | 12/1976 | Hannigan | 2/49 |
| 4,441,212 | 4/1984 | Ahr et al. | 2/49 |

FOREIGN PATENT DOCUMENTS 1463863 2/1977 United Kingdom .

*Primary Examiner*—Doris L. Troutman
*Attorney, Agent, or Firm*—Paul Yee

[57] ABSTRACT

A baby's bib is provided with a crumb catcher designed to retain an open position due to the use of an involute semi-rigid spacer means which connects the crumb catcher to the bib.

16 Claims, 3 Drawing Figures

BIB WITH CRUMB CATCHER

CROSS-REFERENCE TO RELATED CASES

This is a continuation-in-part of U.S. Pat. application serial No. 638,187 filed Aug. 6, 1984.

BACKGROUND OF THE INVENTION

Disposable bibs are generally made of a sheet of material which is fluid impervious on the body facing side and fluid retentive on the outward side to retard the spillage and over-run of fluid when it contacts the outward surface. These disposable bibs may be fastened about the neck by a string or by an arcuate extension of one side of the bib material which is designed to encircle the neck and mate with a portion of the other side of the bib extending upward. This mating is usually by adhesive means. British Pat. No. 1,463,863 describes such a bib. In another variation, the bib may have a crumb catcher attached near the bottom end and extending along the entire width of the bib at its bottom part. This crumb catcher is designed to form an open pocket which provides a trough for both liquid and solid particles which dribble down the front of the bib and could otherwise soil the clothing of the wearer. U.S. Pat. No. 2,367,383 describes a crumb catcher which extends outward from the bib surface due to the formation of gussets along each side. While the gussets can perform the spacing function, the relatively flimsy easily deformable nature of the material used for a bib inhibits the successful use of the gussets to form suitable spacing means. The gussets themselves may be crushed and rendered non-resilient during packaging and there may not be enough weight of the crumb catcher to assist the gusset in maintaining the proper open configuration. In addition, manufacture is difficult because of the odd profile necessary to produce a bib blank featuring gussets.

U.S. Pat. Nos. 3,146,464; 3,329,969; 3,416,157; and 3,328,807 disclose crumb catchers which are formed by adhesive on the sides of a folded-over bottom portion of the bib. U.S. Pat. Nos. 2,423,489; 2,782,420; and 3,995,321 disclose crumb catchers which are spaced from the main bib part.

SUMMARY OF THE INVENTION

The present invention provides a protective garment, such as a bib, which is easy to manufacture and has a distinctive configuration of spacer means. The spacer means will not be crushed during packaging and can be selectively actuated or engaged by the user. The protective garment article includes a sheet member which has an appointed body surface, an appointed outward facing surface, an upper end portion and a flexible bottom end portion. Mounting means connected to the sheet member suitably hold the garment on a wearer, and a flexible sheet-type catcher member is positioned in facing relation with the body facing surface of the sheet member bottom portion. Attaching means connect selected edge portion of the catcher member to the sheet member to form a passive pouch-type structure which opens onto the body facing surface of the sheet member. The attaching means is constructed and arranged to constrain and hold the sheet and catcher members to thereby produce a spacer means which operably spaces the catcher member away from the outward facing surface of the sheet member when the connected sheet and catcher members are turned inside out to form an active, pouch-type structure which opens onto the outward facing surface of the sheet member.

The present invention further provides a method for producing a protective garment which includes the step of providing a sheet member which is constructed for mounting on a garment wearer. The sheet member has an appointed body facing surface, an appointed outward facing surface, an upper end portion, and a flexible bottom end portion. A flexible, sheet-type catcher member is positioned in facing relation with and adjacent to the body facing surface of the sheet member bottom portion. Selected edge portions of the catcher member are connected to the sheet member to form a passive pouch structure which opens onto the body facing surface of the sheet member. The connected sheet and catcher members are involuted, i.e. turned inside out, to thereby form an active pouch-type structure which opens onto the outward facing surface of the sheet member. The secured edges of the crumb catcher and main portion of the bottom edges of the bib are positioned within the crumb catcher active pouch and serve to maintain the catcher member spaced from the remainder of the bib. Since the involute positioning is done by the user, the spacer means are not utilized and cannot be crushed or distorted in any way until the crumb catcher itself is turned inside out and repositioned for use.

BRIEF DESCRIPTION OF THE DRAWINGS

The present invention will be more fully understood and further advantages will become apparent when reference is made to the following detailed description of the invention and the drawings in which.

DETAILED DESCRIPTION OF THE INVENTION

Figure 2:
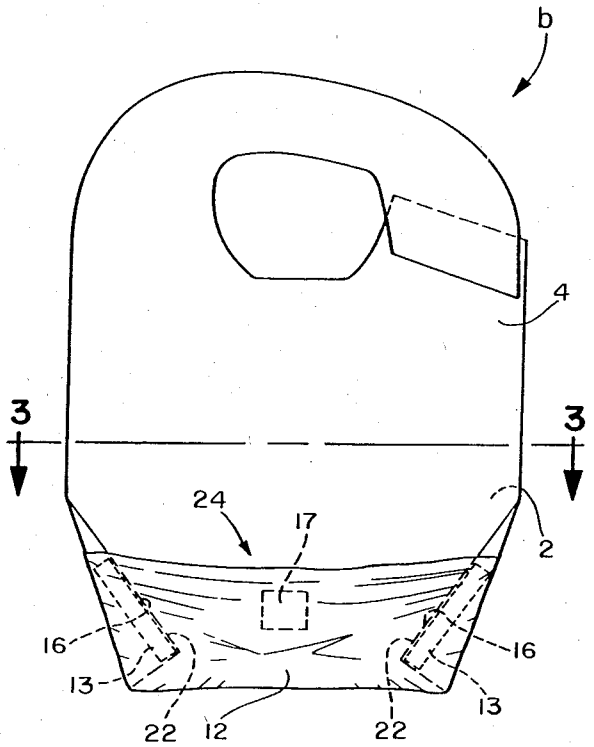
FIG. 2 representatively shows a front plan view of the bib article after the primary sheet member and the interconnected catcher member are turned inside out to activate the spacer means.
Figure 1:
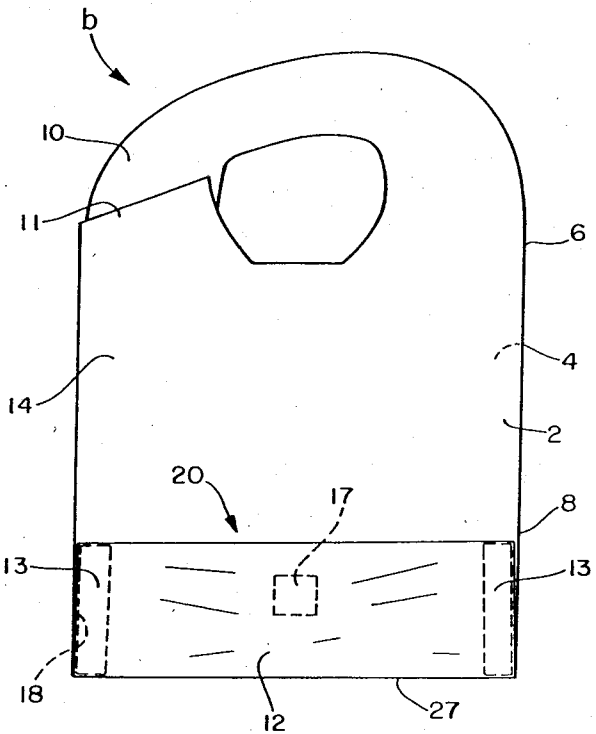
FIG. 1 representatively shows a back plan view of a bib article after manufacture but prior to use.

As representatively shown in FIG. 1, a protective garment article, such as a bib, includes a sheet member, such as body portion 14 having an appointed body facing surface 2, an appointed outward facing surface 4, an upper end portion 6 and a flexible bottom end portion 8. Mounting means, such as arcuate member 10, is connected to sheet member 14 to suitably hold the garment on a wearer. A flexible sheet-type catcher member 12 is positioned in facing relation with body facing surface 2 of bottom portion 8 of the sheet member. Attaching means, such as an adhesive, connect selected edge portions 18 of catcher member 12 to sheet member 14 to form a first, passive pouch-type structure 20 which opens onto the body facing surface 2 of sheet member 14. As shown in FIG. 2, the attaching means is constructed and arranged to constrain and hold the sheet and catcher member to thereby produce a substantially triangular section 22 which operably spaces the catcher member 12 away from the outward facing surface 4 of sheet member 14 when the interconnected sheet and catcher members are turned inside out to form a second, active pouch-type structure 24 which opens onto the outward facing surface 4 of sheet member 14.

Sheet member 14, which comprises the body portion of the bib, may be formed from a single layer of any suitable material, such as paper, woven or non-woven cloth, or plastic. In addition, the sheet member can have any suitable planform shape with straight or curvilinear edges, as desired. Preferably, sheet member 14 includes a plurality of layers which are assembled together by suitable means, such as adhesives or sonic bonds arranged in any suitable pattern. Body facing surface 2 is preferably comprised of a layer of a liquid impermeable material, such as polyethylene, polypropylene, poly vinylchloride or an extrusion coated spunbond material. This liquid impervious sheet may be plain, embossed or pigmented as desired.

Outward facing surface 4 is preferably comprised of a layer of absorbent material, such as a tissue absorbent, a tissue absorbent covered with spunbonded material, a tissue absorbent covered with a perforated film, an air-formed absorbent, or textile fibers formed into an absorbent layer.

The mounting means for donning the protective garment onto a wearer can be selected from a variety of suitable devices, such as straps or an adhesive mounting means with which the bib sheet member is releasably affixed over the outer clothing of the wearer. If a neck strap or an arcuate neck band is employed to mount the bib, the straps may be joined to encircle the wearer's neck by tying or by a suitable adhesive attachment means. For example, various types of commercially available pressure-sensitive adhesive tapes can be employed to affix or secure a neck strap around a wearer's neck. Such tapes can be single use type tapes or they may be refastenable type tapes. In addition, various mechanical fasteners, such as velcro-like material, snaps, hooks, and other interlocking devices can be used to affix a neck strap.

As can be seen in FIG. 1, bib b has a primary body portion 14. A part of this body portion is covered by crumb catcher 12, which extends along the bottom end and transversely across the body portion. Crumb catcher 12 is attached to body facing surface 2 of the main body portion at the lateral side edges to form a composite 13. In a particular aspect of the invention, crumb catcher 12 can be attached to the main body portion 14 at bottom edge 26 to form the composite. This composite at its narrowest portion preferably extends at least ¼" inward from the lateral or bottom edges to provide improved effectiveness. The body facing surface 2 of the bib sheet member 14, as well as the body facing surfaces of the neck attachment portions formed by arcuate member 10 and mating extension 11, are made of fluid impervious material designed to protect the clothes of the wearer. As manufactured, the crumb catcher 12 is preferably sealed or otherwise attached to the fluid impervious body facing surface 2 of the bib along selected edge portions of the catcher member. For example, crumb catcher 12 may be attached to sheet member 14 at the two lateral side edges of the crumb catcher, or at the bottom edge of the crumb catcher at bottom edge 26 of the bib, or at both the side edges and the bottom edge of the crumb catcher.

Catcher member 12 may be composed of a material different then the material of sheet member 14, or the catcher member may be composed of the same material as the sheet member. Also, catcher member 12 may be a piece which is separate from sheet member 14, or the catcher member may be a continuous extension from sheet member 14 which is folded back along edge 27 and placed adjacent to the sheet member. Selected edges of catcher member 12 can be connected to sheet member 14 by an adhesive bond or by a sonic bond. Alternatively, the sheet and catcher members may be interconnected by the application of pressure and heat to form a cohesive bond therebetween.

FIG. 2 shows the bib positioned for use wherein the sides of the bib extending downward form spacer means represented by dotted lines 16 which extend downward and inward in an essentially triangular configuration. The spacer means operably separates crumb catcher 12 from the main body portion of the front surface 4 of the bib. This front, outward facing surface is designed to be fluid retentive; i.e., it has sufficient absorbency to at least inhibit the rate of downward flow of spilled fluid. In a particular embodiment, the absorbent layer provides the back surface of active pocket 24 formed by the crumb catcher and the now involutely positioned spacer means. However, extension of the absorbent portion into the crumb catcher pouch is not required.

Figure 3:
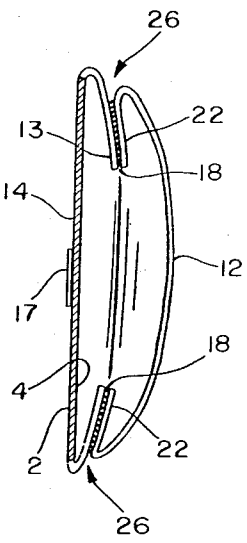
FIG. 3 representatively shows a longitudinal view taken along cross section 3—3 of FIG. 2.

FIG. 3 representatively shows the involute spacer means 26 provided by the present invention. Attaching means 18 is constructed and arranged to constrain and hold the sheet member 14 and the catcher member 12 together to form a substantially flat composite section 13. Composite section 13 may be comprised of a localized patch or series of patches, or the composite section may be comprised of a substantially continuous area that forms a seal along the joined edges of sheet member 14 and catcher member 12. As a result, when the interconnected sheet member and catcher member are turned inside out to form active pouch 24 opening onto the outward facing surface 4, as shown in FIGS. 2 and 3, the interconnected portions of the sheet and catcher members produce an inwardly curled (or otherwise inwardly turned) involute spacer section 26 which operably spaces catcher member 12 away from outward facing surface 4 of sheet member 14. As can be seen in FIG. 2, the curled portions of catcher member 12 and sheet member 14 form a tucked-in portion which extends inside pouch 24 and in between catcher member 12 and outward facing surface 4 of sheet member 14. This tucked-in portion is substantially triangular in shape.

An additional feature of the bib of this invention is an adhesive positioning patch 17 shown in FIGS. 1 and 2. The adhesive means is preferably positioned on a part of surface 2 within the area covered by crumb catcher 12, although it may optionally be located elsewhere on surface 2. When the crumb catcher is positioned and activated for use as described previously, the adhesive patch 17 is positioned to releasably attach the bib to the clothing of the baby. While the Figures show a single adhesive patch 17, there may alternatively be a plurality of noncontiguous patches or other network or pattern of adhesive.

Depending upon the choice of the adhesive and bib material, a separate release paper covering the adhesive patch may be desirable. The release paper may remain attached within the pouch to a portion of the adhesive patch. Alternatively, the release liner may be attached to and retained by a contacting surface of crumb catcher 12. In a further embodiment of the invention, the adhesive patch may be comprised of an encapsulated adhesive. There would be no release liner, but one would have to scrape or otherwise break the capsules which contained the adhesive in order to activate the patch. In still a further embodiment of the invention, the release liner may be a separate piece which has its own adhesive that can be reaffixed to the front of the bib as a decoration. If desired, the adhesive patch may even be one which is activated by moisture.

It will be appreciated by those skilled in the art that the degree of stiffness of the activated spacer means is dependent upon the stiffness of both surfaces of the main body portion 14 of the bib as well as the crumb catcher 12. Also, stiffness may be provided if an adhesive is used to form the composite. Stiffening will occur generally if the crumb catcher is fused to the fluid impermeable surface 2, although due to the relatively wide band desired to obtain proper spacing and the amount of energy required for such fusing, the adhesive securement of the crumb catcher is preferable. It is also preferred that at the narrowest dimension of the attachment, the composite of the edge of the crumb catcher with the edge of the main body of the bib extends at least a quarter of an inch inward on each side to provide improved effectiveness. It can readily be understood that particular configurations of the crumb catcher and the subsequent extension of the spacing means can be adjusted by adjusting the configuration of this composite. While the Figures generally show the edges of the composite as generally parallel to the edges of the bib body, the spacer means can be widened and the lateral dimension of the crumb catcher in use can be decreased by forming a triangular shaped composite which in turn induces the formation of the spacer means. Additionally, the two composite edge portions may be otherwise arranged or configured to be nonparallel with each other.

The neck portion of the bib is designed so the arcuate portion 10 generally overlaps the shortened portion 11. Securement of the arcuate extension 10 to the shorter extension 11 is generally by adhesive means, and when the baby pulls on the extended tab, the force will be exerted downward thereby tending to maintain the adhesive attachment. Alternatively, the shorter flap 11 with the leading edge facing upward can be positioned on the outward side of the bib. However, with such an arrangement, the baby pulling on the tab would tend to release the bib. It is generally preferred to make the composite with a total strength of at least 6700 grams to maintain the neck attachment means in position without having it torn by an active baby.

It will be readily apparent to a person having ordinary skill in the art that various changes and modifications can be made without departing from the spirit of the invention. Such changes and modifications are all contemplated as being within the scope of the invention as defined by the subjoined claims.

I claim:

1. A protective garment article, comprising:

(a) a sheet member having an appointed body facing surface, an appointed outward facing surface, an upper end portion and a flexible bottom end portion;

(b) mounting means connected to said sheet member for holding said garment on a wearer;

(c) a flexible, sheet-type catcher member positioned in facing relation with the body facing surface of said sheet member bottom portion; and (d) attaching means for connecting selected edge portions of said catcher member to said sheet member to form a passive pouch-type structure which opens onto the body facing surface of said sheet member, said attaching means constructed and arranged to constrain and hold said sheet and catcher members to thereby produce a spacer means which operably spaces said catcher member away from the outward facing surface of said sheet member when said connected sheet and catcher members are turned inside out to form an active pouch-type structure which opens onto the outward facing surface of said sheet member.

2. An article as recited in claim 1, wherein said attaching means connects the selected edge portions of said catcher member to the body facing surface of said sheet member to form said passive pouch-type structure opening onto the body facing surface of said sheet member.

3. An article as recited in claim 1, wherein said attaching means is constructed and arranged to constrain and hold said sheet and catcher members to thereby produce a turned, involute spacer section which operably spaces said catcher member away from the outward facing surface of said sheet member.

4. An article as recited in claim 1, wherein said attaching means is constructed and arranged to provide a spacer section which includes a substantially triangular portion formed when said connected sheet and catcher members are turned inside out to form said second pouch-type structure, said triangular portion located inside of said second pouch-like structure.

5. An article according to claim 1 wherein said crumb catcher and said sides are bonded together to form a composite having one part of at least ¼ inch in length extending inward from two side edges of said sheet member.

6. An article according to claim 1 wherein the neck attachment means are formed by releasability adhesively attaching an arcuate extension of one side to an underlying extension of the opposite side.

7. An article according to claim 1 further comprising adhesive positioning means located on the body facing surface of said sheet member.

8. A method for producing a protective garment, comprising the steps of:

(a) providing a sheet member which is constructed for mounting on a garment wearer, said sheet member having an appointed body facing surface, an appointed outward facing surface, an upper end portion, and a flexible bottom end portion;

(b) positioning a flexible, sheet-type catcher member in facing relation with and adjacent to the body facing surface of said sheet member bottom portion;

(c) connecting selected edge portions of said catcher member to said sheet member to form a first pouch-type structure which opens onto the body facing surface of said sheet member; and (d) turning said connected sheet and catcher member inside out to thereby form a second pouch-type structure which opens onto the outward facing surface of said sheet member.

9. A method as recited in claim 8, wherein said selected edge portions of the said catcher member are connected to the body facing surface of said sheet member to form said passive pouch structure which opens onto the body facing surface of said sheet member.

10. A method as recited in claim 8, wherein said turning step (d) forms said sheet and catcher members to produce a turned, involute spacer section which operably spaces said catcher member away from the outward facing surface of said sheet member.

11. A method as recited in claim 8, wherein said turning step (d) produces a substantially triangular portion located between said catcher member and the outward facing surface of said sheet member.

12. A method as recited in claim 8, further comprising the step of locating an adhesive network or pattern on the body facing surface of said sheet member within said first pouch structure.

13. A protective garment article, comprising:

(a) a sheet member having an appointed body facing surface, an appointed outward facing surface, an upper end portion and a flexible bottom end portion;

(b) mounting means connected to said sheet member for holding said garment on a wearer;

(c) a flexible, sheet-type catcher member positioned in facing relation with the outward facing surface of said sheet member bottom portion; and (d) attaching means for connecting selected edge portions of said catcher member to said sheet member to form an active pouch-type structure which opens onto the outward facing surface of said sheet member, said attaching means constructed and arranged to constrain and hold said sheet and catcher members in an inwardly turned configuration to thereby produce a spacer section which operably spaces said catcher member away from the outward facing surface of said sheet member.

14. An article as recited in claim 13, wherein said attaching means connects the selected edge portions of said catcher member to the body facing surface of said sheet member to form said inwardly turned spacer section.

15. An article as recited in claim 13, wherein said attaching means is constructed and arranged to provide a spacer section which includes a substantially triangular portion located within said active pouch-type structure and located between said catcher member and the outward facing surface of said sheet member.

16. An article as recited in claim 13, further comprising adhesive positioning means located on the body facing surface of said sheet member.

* * * * *